US008047672B2

(12) United States Patent
Kotulla

(10) Patent No.: US 8,047,672 B2
(45) Date of Patent: Nov. 1, 2011

(54) MOSAIC FLOORS AND CORRESPONDING INSTALLATION PROCEDURES

(76) Inventor: Carmen Kotulla, Stuttgart (DE)

( * ) Notice: Subject to any disclaimer, the term of this patent is extended or adjusted under 35 U.S.C. 154(b) by 66 days.

(21) Appl. No.: 12/280,373

(22) PCT Filed: Feb. 22, 2007

(86) PCT No.: PCT/DE2007/000335

§ 371 (c)(1),
(2), (4) Date: Aug. 2, 2010

(87) PCT Pub. No.: WO2008/116431

PCT Pub. Date: Oct. 2, 2008

(65) Prior Publication Data

US 2010/0290216 A1 Nov. 18, 2010

(30) Foreign Application Priority Data

Feb. 25, 2006 (DE) ..... 10 2006 008 848

(51) Int. Cl.
*F21S 8/00* (2006.01)

(52) U.S. Cl. ..... 362/153; 362/145; 362/227; 362/234; 362/253; 362/576

(58) Field of Classification Search ..... 362/145, 362/153, 153.1, 227, 234, 249.01, 253, 551, 362/559, 565, 576
See application file for complete search history.

(56) References Cited

FOREIGN PATENT DOCUMENTS

DE 102004023707 A1 12/2005
EP 1469141 A1 10/2004

OTHER PUBLICATIONS

International Search Report dated Oct. 1, 2007.

*Primary Examiner* — Stephen F Husar
*Assistant Examiner* — Meghan Dunwiddie
(74) *Attorney, Agent, or Firm* — Howard IP Law Group, PC

(57) ABSTRACT

The invention relates to a mosaic floor (20) consisting of layers and comprising at least one mosaic section (26) comprising illuminating elements (3) that are integrated into the mosaic floor (20) and the structure comprises at least the following layers: a mosaic layer (13) that has a plurality of individual mosaic elements (2) and a plurality of individual illuminating elements (3), said illuminating elements (3) being connected to an electric cable or to a light conductor (4), in particular glass fibres, that are introduced from below, a channel layer (14) that comprises at least one rigid plate (7) having a channel system (15) that is open to the top or to the bottom in which the electric cable or the light conductor (4) are laid.

20 Claims, 11 Drawing Sheets

MOSAIC FLOORS AND CORRESPONDING INSTALLATION PROCEDURES

Figure 1:
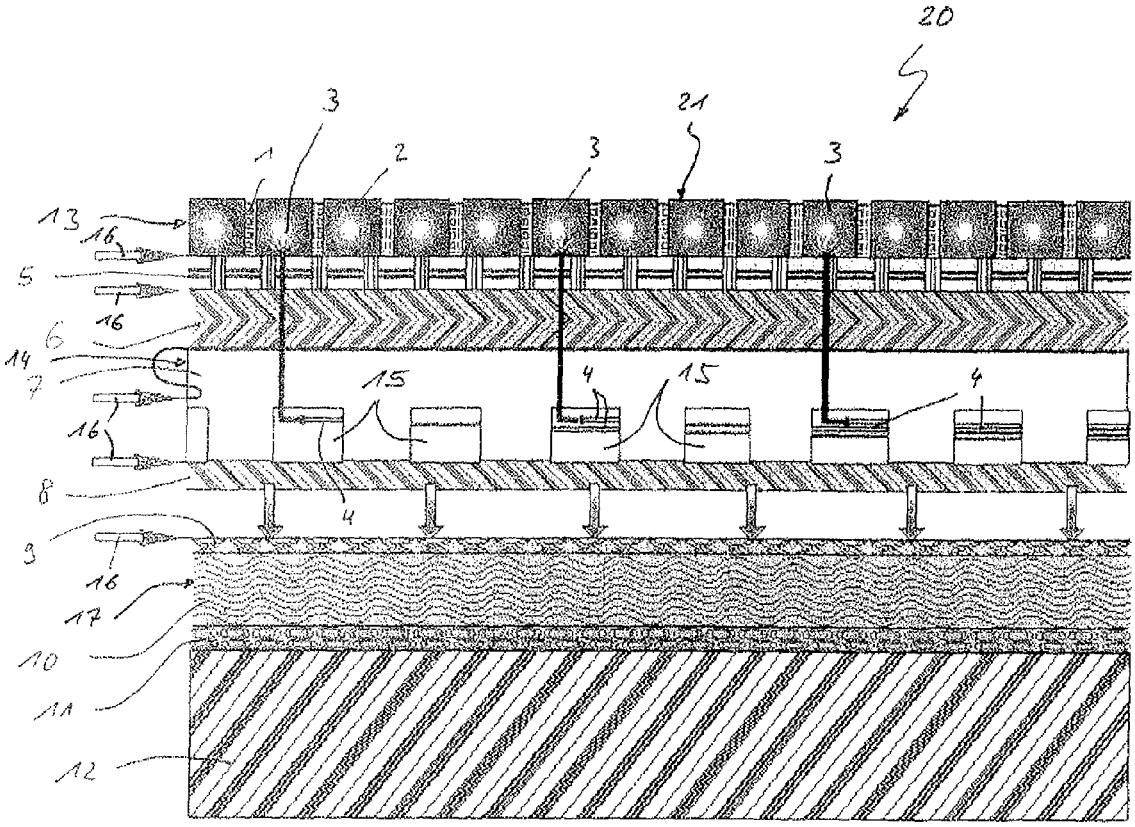

The invention relates to a building floor provided with a mosaic. The invention relates in addition to a method for laying such a mosaic floor on a building.

For centuries, mosaics, in particular made of marble, are a craftsmanship with ancient tradition. Laying or installing mosaics requires skilled artists who, with a lot of experience, manually cut small marble pieces or chips and join them together to form a picture. The mosaic is a great medium through which any type of design can be expressed effectively, in particular on floors, walls, or ceilings. The mosaic surface has an extraordinary artistic expression and, because it is completely handmade, appears as an individual piece of art.

The beauty of a polished mosaic lies in the glitter effect generated by light which is reflected by thousands of marble chips which are all laid with different angles to one another. From a distance, the mosaic generates the beautiful surface effect of sparkling diamonds.

Until today, mosaic artworks, in particular with marble mosaics, are products which are completely handmade. To simplify the fabrication of mosaics, special fabricating systems and supporting nets attached on the back side have been developed which allow to fabricate high-volume mosaic artworks without losing the artistic appearance of the product. Through these possibilities and through improved technical support, in connection with extensive experience when laying mosaics, it is possible to use this unique product on industrially used floors which have high traffic requirements. Such industrial applications can be found, for example, in company buildings, hotels, casinos, embassies, government buildings and shopping centers.

The final success of each mosaic installation depends on a highly experienced team of craftsmen and carefully selected installation materials and laying system. For this it is absolutely necessary to implement any kind of expansion connections or expansion joints in a quasi invisible manner within the decorative joint material of the mosaic because otherwise such expansion connections would destroy the design and artistic expression of the artwork.

The entire installation system must be compatible. Also, the entire construction must have a sufficient flexibility throughout the entire structure to avoid cracks in the mosaic surface or in the floor connections. For this reason, a structural integrity of the system is required to provide an abrasion-resistant, durable floor surface which, at the same time, retains its wonderful artistic appearance.

The mosaic finish, thus the grout filling of the joints between the individual mosaic chips requires a watertight system which has to be applied onto the installed reinforced concrete bed. Any moisture through this system would sooner or later cause that the mosaic chips get detached from the supporting net whereby the artwork would be partially destroyed. Mosaics must be laid on a completely plane and flat subsurface to avoid an uneven appearance of the mosaic surface after laying.

Also, maintenance of the mosaic floors plays an important role. For cleaning the finished mosaic floor, any kind of polishing machine should be avoided because the same would sooner or later eliminate the thin unevenness of the individual marble chips; in addition, the surface would then lose its glittering appearance.

Modern mosaics can be combined with illumination effects. In particular, illuminated crystals made from mosaic chips can be integrated in the mosaic. Hereby, the traditional marble chips are mixed in an unusual manner with brilliantly shimmering crystals and in particular combined with light and music to generate a truly magical scenario.

Glass fiber illumination creates dramatic illumination effects in any environment one can imagine. In combination with crystal mosaics, new ideas can be implemented into an astonishing reality. Through the freedom to integrate a wide range of special effects in light design, it is now possible to produce an extraordinary mixture of products which is brought to life by glass fiber illumination.

In order to be able to provide such a complex modern mosaic in a durable manner and for highest loads, the present invention proposes a special structure for the mosaic floor and an associated installation method.

Hereinafter, with reference to the FIGS. 23*a* and 23*b*, a conventional standard installation system (without illumination) is described which is used for normal mosaic floors, in particular marble mosaics.

First, a basic pre-preparation of the floor is necessary. The pre-preparation of the floor surface prior to the mosaic installation is very important for the final result. A concrete bed 107 which is in particular reinforced by steel reinforcements serves as starting basis. Onto the concrete bed 107, e.g., one or two layers of a two-component epoxy resin 106 are applied for priming, on the one hand, and for sealing, on the other, to generate an effective sealing against water and water vapor to thereby avoid penetration of moisture into the structure. The mosaic finish requires a smooth and very flat surface prior to laying the mosaic. After the system is implemented in a watertight manner it is thus necessary to apply a self-leveling, smoothening floor mixture 105. After that, a dispersion primer 104 has to be applied to achieve, with an adhesive, a well-bonding finish. After a predetermined drying and curing time, the floor is ready for the installation.

Now, the basic mosaic installation follows. By using a suitable adhesive 108, the individual mosaic elements 101 can be placed according to FIG. 23*a* directly onto the primer 104. Subsequently, the mosaic elements 102 are grouted with joint material 101 and after that, the mosaic finish is created. In order to be able to carry a high traffic volume in an industrial building, according to FIG. 23*b*, e.g., a fiber board 103 can be installed underneath the mosaic finish, which fiber board can absorb stress, is pressure-resistant, and is made, e.g., from a compressed polyester. Said fiber board 103, which is in particular reinforced with glass fibers and/or carbon fibers, serves in a very effective manner to prevent cracks, which may occur in the floor structure, from reaching the mosaic surface. Since mosaic areas of the handmade artwork are difficult to replace in part, it is of vital importance to avoid any risk of cracks which could destroy the design. Onto the installed panels or boards 103, a mosaic adhesive can be applied so that finally the mosaic artwork can be placed on it and grouted. It is also possible to use the boards 103 for prefabrication of sections of the mosaic floor which allows it to implement the actual laying of the floor faster.

Pure mosaics can be fabricated industrially. Here it is possible to install this type of mosaics directly onto the specified pre-prepared floor without using the stress-distributing underlay board 103 if a particularly inexpensive installation is required. Pure mosaics can principally be replaced in parts at any time.

The above described standard installation system can only be used without illumination. As soon as a modern mosaic is to be combined with illumination effects, a conventional standard installation can not be used any more.

The present invention is concerned with the problem to provide, for a mosaic floor with illumination effects or for an associated installation method, respectively, an improved embodiment which is in particular characterized by a comparatively simple laying and preferably by a sufficient stability.

This problem is solved according to the invention by the subject matters of the independent claims. Advantageous embodiments are subject matter of the dependent claims.

The invention is based on the general idea to construct the mosaic floor in layers, wherein the individual layers can be fabricated separately in particular within a prefabrication, which simplifies the laying of the floor considerably. Essential is here the subdivision of the mosaic floor in a mosaic layer which comprises the individual mosaic elements and the illuminating elements, wherein the illuminating elements are already connected to an electric cable or light conductor which is guided at the bottom out of the mosaic layer, and a channel layer in which a channel system for accommodating and laying the electric cables or light conductors is formed.

The original standard mosaic artwork requires a fabrication in a separate factory. Variants of crystal mosaic elements in different colors and shapes can be integrated. Therefore, it can be necessary to partly re-cut the mosaic panels according to the original mosaic design.

Further important features and advantages of the invention arise from the sub-claims, the drawings, and the associated description of the figures based on the drawings.

It is to be understood that the features mentioned above and yet to be illustrated hereinafter can be used not only in each of the specified combinations but also in other combinations or alone without departing from the present invention.

Figure 2:
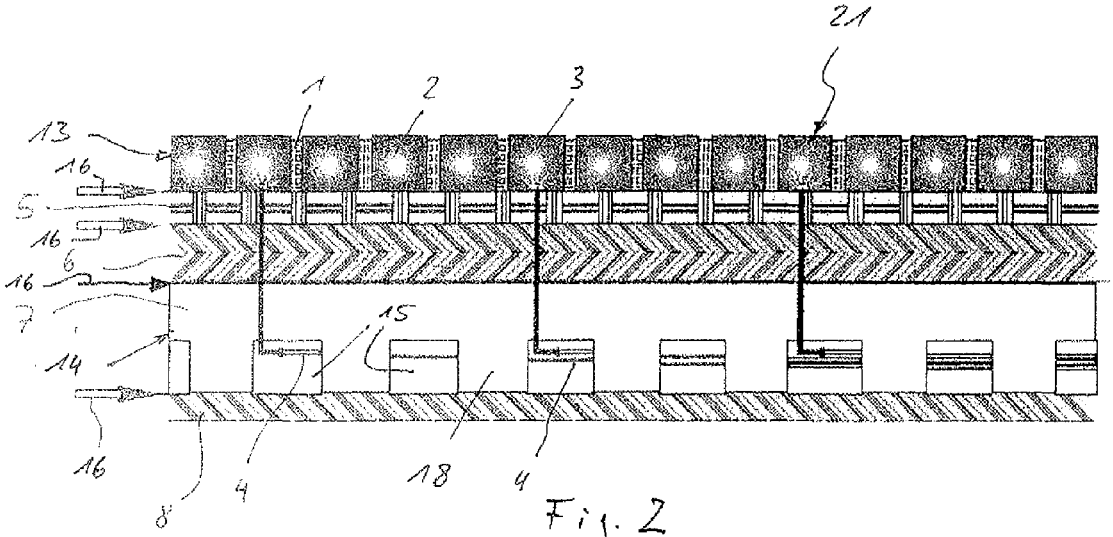
Figure 3:
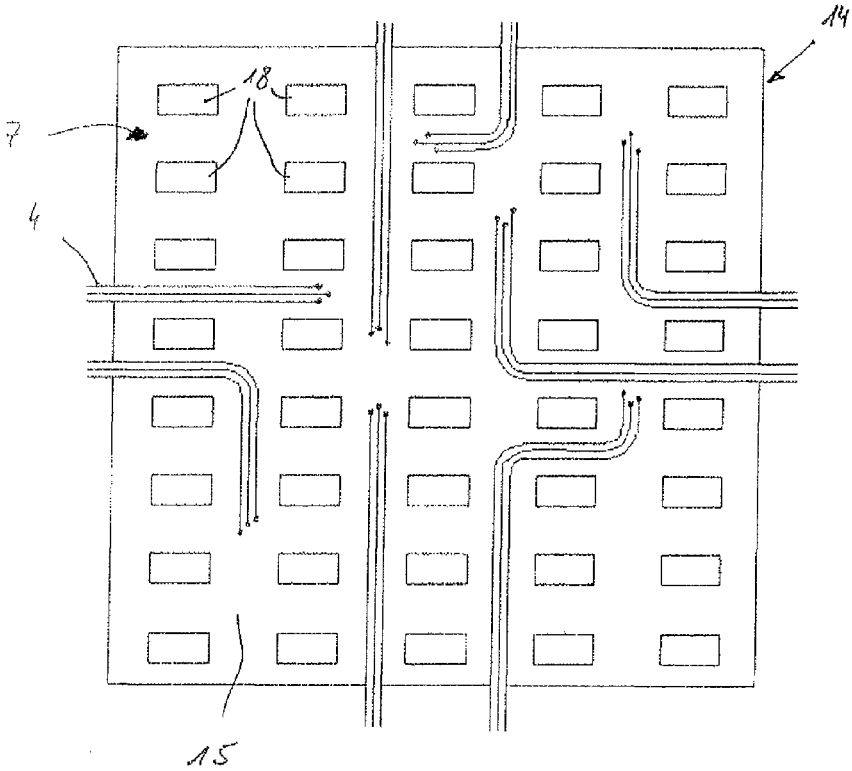
Figure 4:
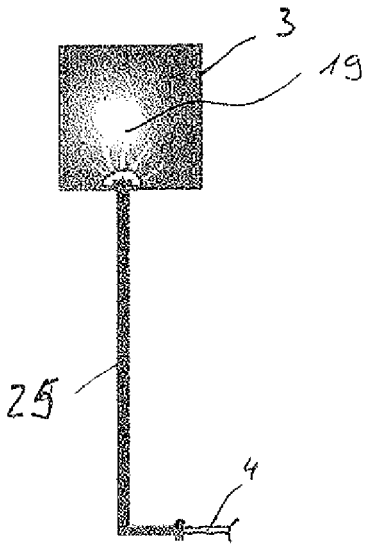
Figure 5:
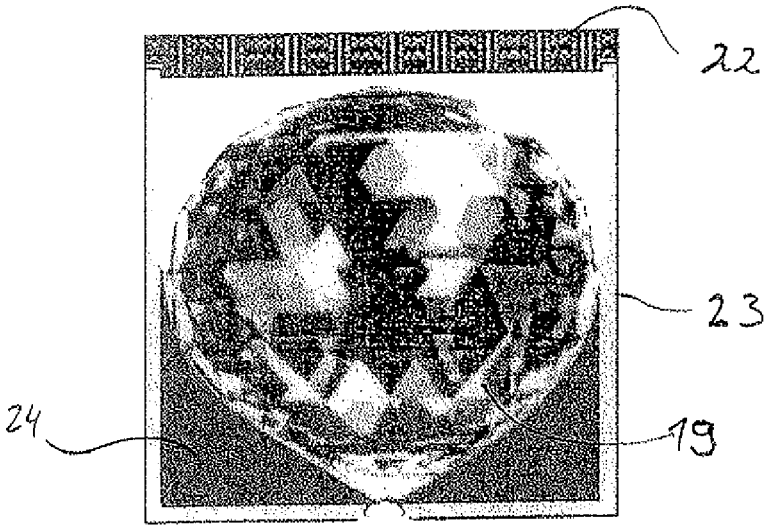
Figure 6:
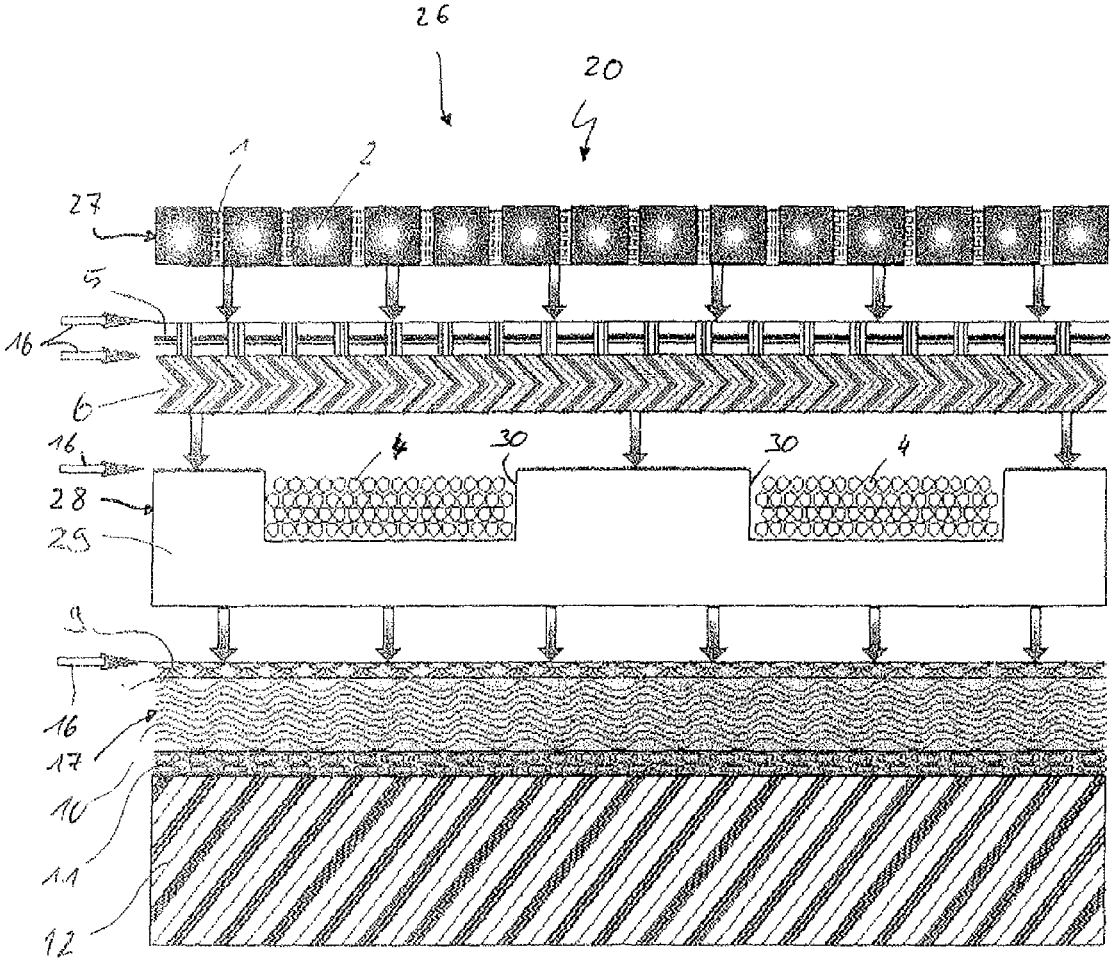
Figure 7:
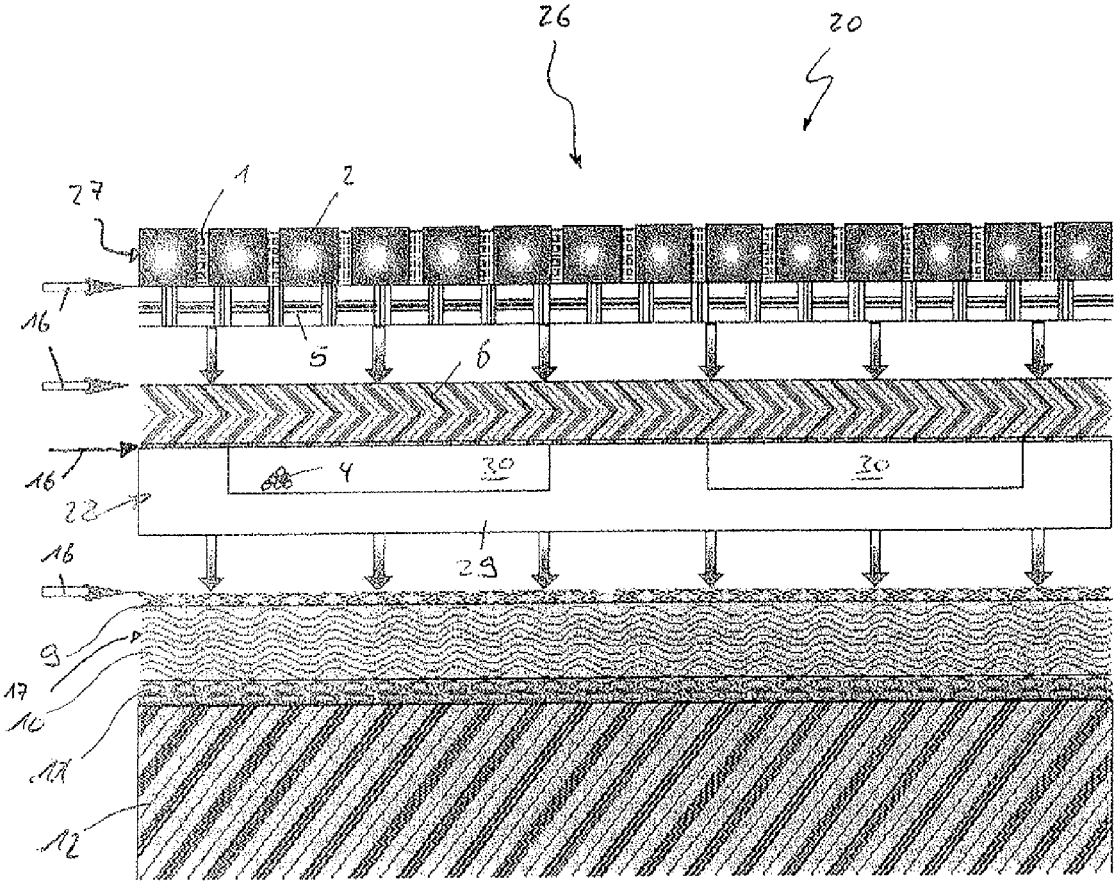
Figure 8:
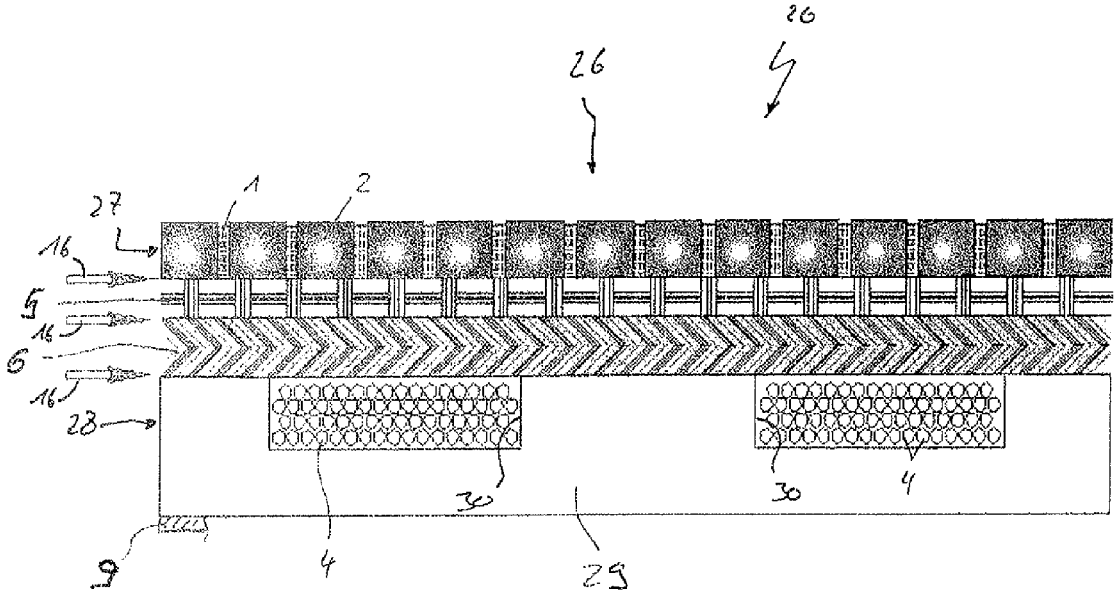
Figure 9:
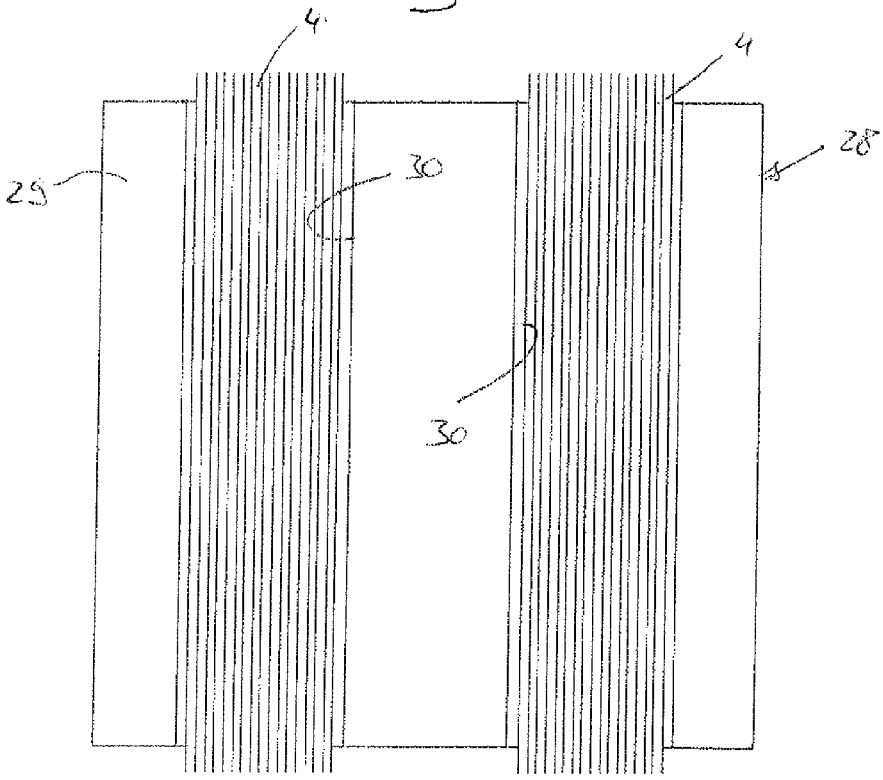
Figure 21:
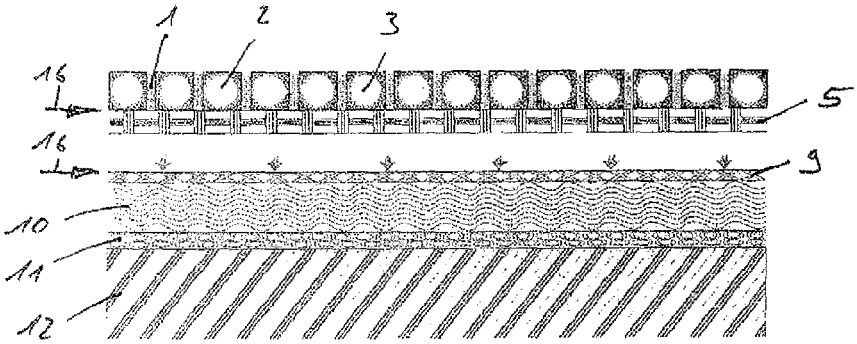
Figure 22:
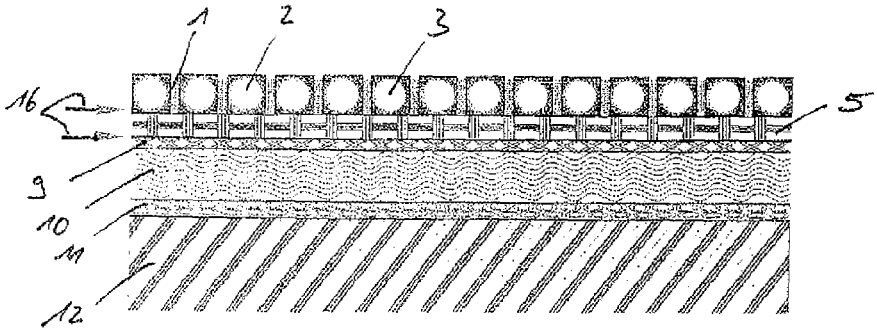
Figure 23A:
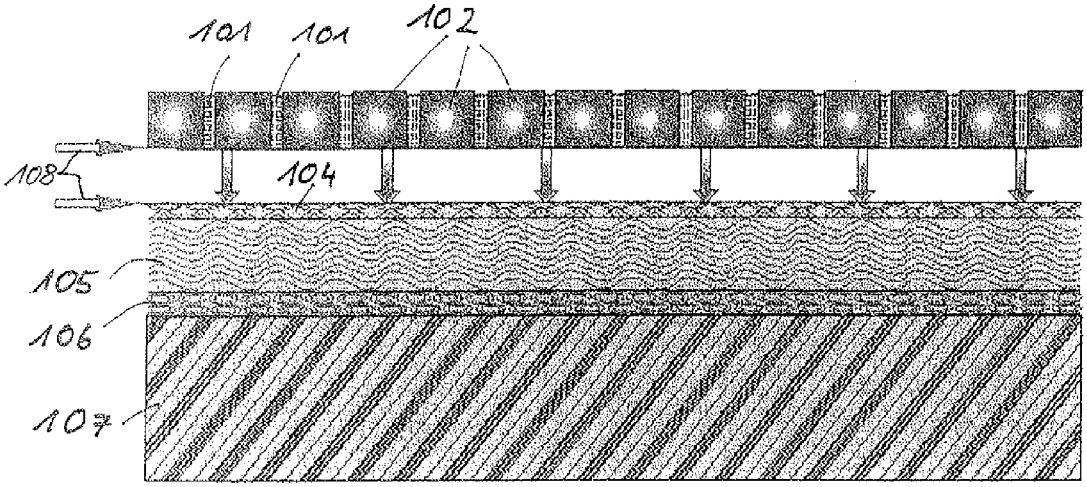
Figure 23B:
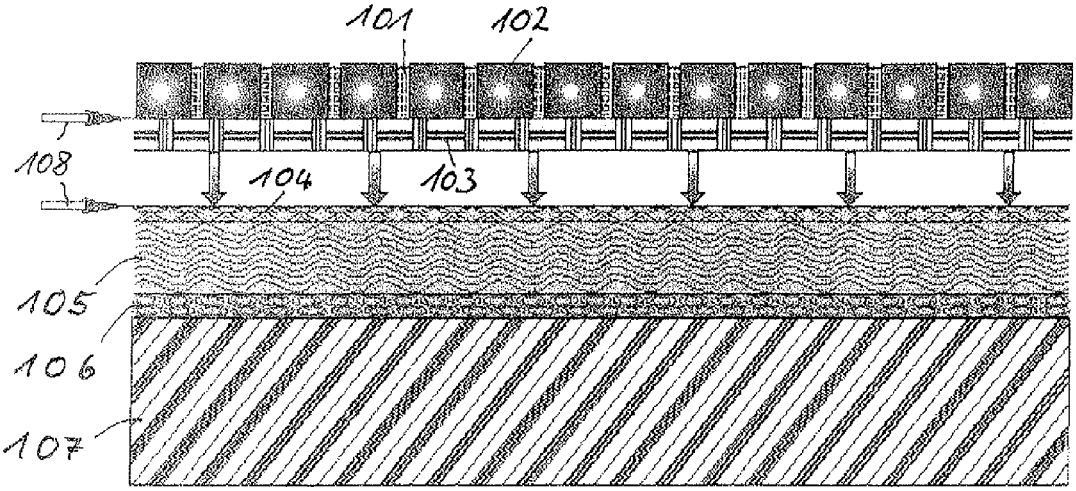

Preferred exemplary embodiments of the invention are illustrated in the drawings and are explained in the following description in more detail, wherein identical reference numbers relate to identical or similar or functionally identical components. In the figures, schematically:

FIG. 1 shows a sectional view of a mosaic floor during laying of prepared mosaic panels, FIG. 2 shows a sectional view of a prefabricated mosaic panel, FIG. 3 shows a view of a channel system of a channel layer, FIG. 4 shows an enlarged detail of the mosaic floor, namely an illuminated mosaic element, FIG. 5 shows an enlarged illustration of the illuminated mosaic element, FIG. 6 shows an exploded view of the mosaic floor, FIG. 7 shows a view as in FIG. 6 but for a different embodiment, FIG. 8 shows a view on a prefabricated mosaic panel, FIG. 9 shows a view on a channel system of a channel layer, FIGS. 10 to 15 show a top view on a mosaic floor during a different fabricating phase, FIGS. 16 to 22 each show a sectional view of a mosaic floor in different fabricating stages, FIG. 23*a* shows a sectional view of a conventional mosaic floor, FIG. 23*b* shows a sectional view as in FIG. 23*a* but for a different embodiment.

According to FIG. 1, a mosaic floor 20 comprises at least a mosaic section as shown here in which illumination elements 3 are integrated. At least in this mosaic section provided with the illuminating elements 3, the mosaic floor 20 has a layered structure comprising at least one mosaic layer 13 which has a plurality of individual mosaic elements 2 and a plurality of individual illuminating elements 3. The illuminating elements 3 are connected to electric cables or, as shown here, to light conductors 4. Said electric cables or light conductors 4 are guided from the bottom to the mosaic layer 13 or the illuminating elements 3. In the present context, the terms "bottom" and "top" relate to the installation situation of the mosaic floor. Furthermore, the mosaic floor's 20 section provided with the illuminating elements 3 comprises a channel layer 14. The same consists of at least one rigid plate 7 which has a channel system 15 in which the electric cables or light conductors 4 of the mosaic layer 13 are laid.

The embodiment of the mosaic floor 20 shown in FIG. 1 shows a comparatively complex layered structure with the following additional layers which can be available alternatively or cumulatively. Here, for example, one (first) intermediate layer is provided which consists of a flexible plate 5. The mosaic layer 13 rests on top of said flexible plate 5. In particular, the individual mosaic elements 3 are glued onto the flexible plate 5. An adequate adhesive is indicated here by an arrow and is designated with 16. Moreover, a further or second intermediate layer can be provided which consists of a rigid plate 6. The rigid plate 6 rests on top of the channel layer 14. Preferably, the first intermediate layer, thus the flexible plate 5, rests on top of the rigid plate 6, thus on top of the second intermediate layer. In particular, the flexible plate 5 can be glued onto the rigid plate 6.

In the example shown here, the channel system 15 of the rigid plate 7 is formed open to the bottom. Principally, an embodiment in which the channel system 15 on the rigid plate 7 is formed open to the top is also possible. The rigid plate 7 involves preferably a fiber foam plate. In case of a channel layer 14 with a channel system 15 that is open to the top, the second intermediate layer, thus the rigid plate 6, can close the channel system 15. The rigid plate 6 is preferably glued onto the rigid plate 7 of the channel system 4.

Moreover, a further or third intermediate layer can be provided which is also formed from a rigid plate 8. On top of this third intermediate layer, thus on top of the rigid plate 8, the channel layer 14 or its rigid plate 7 is placed and can be glued thereto. In the shown example, the rigid plate 8 of the third intermediate layer closes the channel system 15 which is open to the bottom.

The mentioned layers, thus the mosaic layer 13 with the mosaic elements 2 and the illuminating elements 3, the first intermediate layer with the flexible plate 5, the second intermediate layer with the rigid plate 6, the channel layer 14 with the rigid plate 7 and the channel system 15, and the third intermediate layer with the rigid plate 8 can form a completely prefabricated unit which, in the prefabricated state, forms a mosaic panel 21 which can be applied onto the appropriately prepared floor in a particularly simple manner.

For attaching the mosaic floor 20 on a floor, said floor must be prepared appropriately. This involves in particular a floor 12 which consists preferably of concrete and in particular a reinforced concrete. Onto the floor 12, a floor layer 17 is applied; the same comprises exemplary a flowing screed layer 10 by means of which the floor 12 can be leveled. In the shown example, between the floor 12 and the flowing screed layer 10, a synthetic resin layer 11 is applied, e.g. from an epoxy resin, by means of which an efficient sealing against water and water vapor can be achieved. Moreover, the floor layer 17 is provided here with a primer layer 9, e.g. in the form of a dispersion primer which is placed on top of the flowing screed layer 10. Onto the floor prepared in this manner, the mosaic floor 20 can then be placed, in particular in the form of individual mosaic panels 21. For this purpose, an appropriate adhesive 16 is used. Usually, a joint compound is applied not until after the laying of the mosaic panels 21 to fill the gaps between the individual mosaic elements 2 and the illuminating elements 3. However, it is principally also possible that the mosaic panels 21 are already grouted.

FIG. 2 shows a prefabricated mosaic panel 21 which, as an example, is already provided with joint compound 1.

FIG. 3 shows a view from the bottom onto the rigid plate 7 of the channel layer 14 whereby the channel system 15 is visible. As an example, some electric cables or light conductors 4 are indicated here. The channel system 15 is formed substantially by free spaces which exist between a plurality of legs 18 projecting from the rigid plate 7.

The light conductors 4, in particular glass fibers, or cables 4 of the fiber optics are laid in a cable channel system 15 specifically produced for this purpose and are fixed to the plate 7. On each side of the panel 21, the cables are put together and are guided to one or two outlets so that they can be connected later on the construction site with suitable projectors (cf. position 31 in FIG. 14). After cabling, the channel system 15 is closed with the plate 8 to avoid any pressure or damage to the cables 4 and to have everything available for the installation on the floor area. The material of the channel system 15 is composed of a highly resistant foam plate 7 or glass fiber foam plate 7 and is pre-cut as needed, e.g. with laser.

The portion of the festively illuminated mosaic panel 21, integrated with illuminating elements 3, e.g. crystal mosaics, requires prefabrication in a separate factory and is delivered as finished product to the construction site, ready for installation.

This unit 21 is produced as a sandwich system which includes different layers according to the respective requirements. The mosaic surface including the crystal elements 3 is installed on a decoupling plate 5, e.g. made of polyester glass fibers, which is connected and glued to a highly resistant and resilient plate 6 which provides structural strength to the system.

The crystal mosaic element 21 is pre-connected with the electric cables or light conductors 4, and the cable bundles lie in a channel system 15 specifically developed for this purpose underneath the mosaic surface. They are framed in a sandwich-like manner, e.g. with two compressed glass fiber plates 6, 8 which protect them against any pressure or damage.

FIGS. 4 and 5 show an illuminating system 3 equipped with a mosaic crystal element 19. Said element 19 is covered with a resistant glass guard 22 which is suitable for high foot traffic and has the desired load capacity per $m^2$. Said element 19 could be framed, e.g. with metal 23 or could be produced completely from glass, and it has, e.g., an insert part 24 made from a synthetic material to retain the crystal stone 19.

According to FIG. 4, the electric cable or the light conductor 4, which is in principle flexible, can be connected via a rigid tube section 25 to the respective illuminating element 3. For example, a light conductor 4 can be guided by means of the tube 25 up to the crystal body 19 to conduct light into the crystal body 19 in a particularly effective manner.

FIG. 6 shows a section 26 of the mosaic floor 20 which is not equipped with illuminating elements 3 but consists only of conventional mosaic elements 2. Here too, the layered structure can be implemented. In particular, also this section 26 comprises a mosaic layer or better a cover layer 27 and a channel layer 28. The cover layer 27 comprises the individual mosaic elements 2 and, if necessary, joint material 1. The channel layer 28 comprises a rigid plate 29 which contains individual channels 30 or a channel system 30. The electrical cables or light conductors 4 of an adjacent or other mosaic section 21 with illuminating elements 3 run in these channels 30. For this, the rigid plate 29 can principally be fabricated in the same manner as the rigid plate 7 of the channel system 14 of the mosaic panel 21. The layered structured of said mosaic section 26 is arranged from bottom to top as follows: Onto floor 12, preferably reinforced concrete, another floor layer 17 is applied. Here too, onto the floor 12, a synthetic resin 11 is applied. On top of the same is a flowing screed layer 10 and on top of the latter, a primer layer 9 is arranged. The channels 30 of the rigid plate 29 are open to the top here. The rigid plate 29 too is glued by means of a suitable adhesive 16 onto the primer layer 9. Optionally, between primer layer 9 and rigid plate 29, a further rigid plate can be provided for reinforcement. Onto the rigid plate 29, a further rigid plate 6 is glued. Onto the same, a flexible plate 5 is glued. The mosaic layer 27 is glued onto the flexible plate 5.

The standard mosaic art, which complements the panel 21 equipped with festively illuminated crystal mosaic, is installed on the construction site in the traditional manner. It is much easier to join the individual puzzle elements together if the standard mosaic portions are still on a net underlay and are flexible enough to be able to slide them into the gaps of the rigid prefabricated crystal mosaic units 21.

The portion of the prefabricated crystal mosaic 21 can be positioned directly onto the flowing screed 10. The channel system 15 for the cables 4 of this unit 21 is placed between the elements 26. After laying the cables 4 into the pre-prepared interspaces 30, it is covered according to the FIGS. 7 to 9 with a resistant compressed glass fiber plate to cover the channel system 30 completely. An underlayable decoupling plate 5 is glued onto this structure, and the floor surface thereby reaches the necessary height to be able to install the standard mosaic. After the installation, a very homogenous and even surface of the decorative mosaic is achieved and the mosaic floor can be grouted.

In contrast to the cable system of the pre-prepared crystal mosaic unit 21, it is not necessary to prepare many interspaces because only one or two large cable bundles leave the mosaic panel 21 on each side, which requires that the channels 30 must be dimensioned wider and larger. The system is open to the top so that the cables 4 can be placed therein and after this process, it is then closed with a resistant and resilient plate 6 which is glued directly onto the channel system 30.

With reference to the FIGS. 10 to 15, hereinafter, a method for installing a mosaic floor 20 is illustrated in more detail, wherein the mosaic floor consists of a plurality of mosaic sections with illuminating elements 3 and, apart from that, of mosaic sections without such illuminating elements 3. Here, the individual mosaic floor sections provided with illuminating elements 3 are formed by prefabricated mosaic panels 21.

Figure 10:
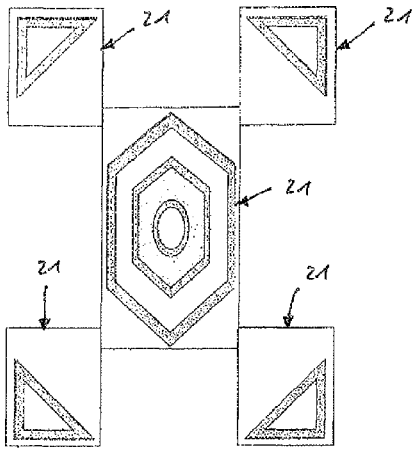
Figure 11:
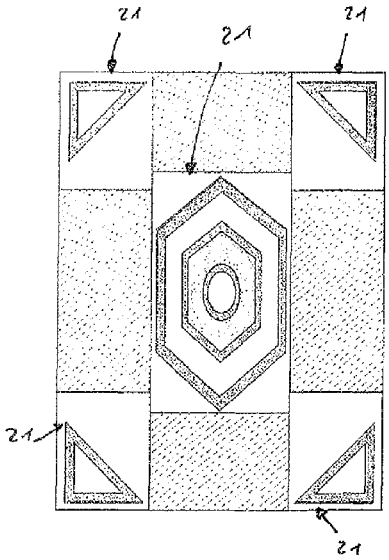

According to FIGS. 10 and 11, the prefabricated festively illuminated crystal mosaic panels 21 are loosely positioned on the prepared floor. The cables 4 are not illustrated.

Figure 12:
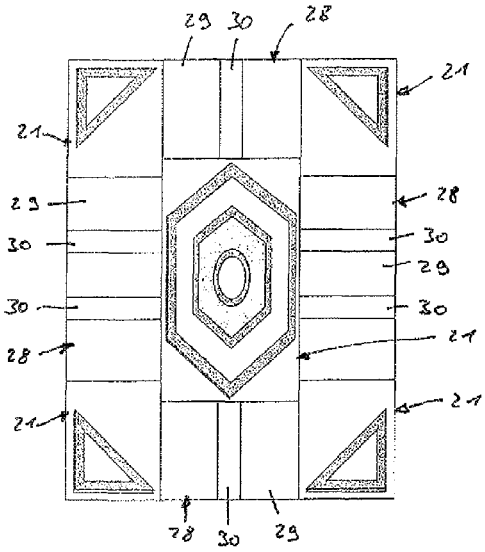

According to FIG. 12, the different areas of the cable channel system 30 of the unilluminated sections are placed between the interspaces, i.e., the plates 29 of the channel layers 28 are arranged with the channels 30 open to the top. Then, the final position of the prefabricated crystal mosaic elements 21 and the cable channel elements 29 are determined and both are glued onto the floor area.

Figure 13:
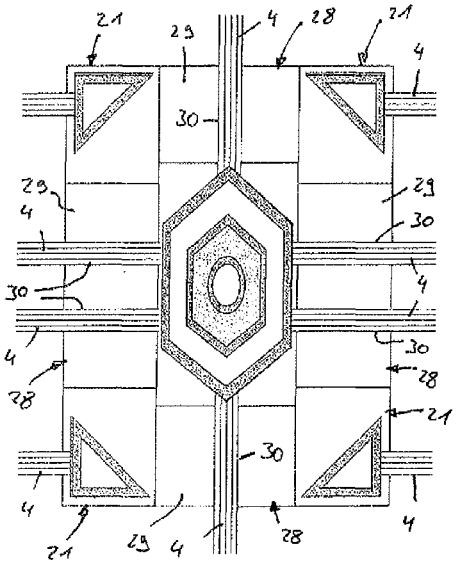

After that, according to FIG. 13, the cables 4 of the prefabricated festively illuminated mosaic units 21 are laid into the pre-cut interspaces of the cable channel 30. They should have an exit towards each side of the mosaic panel 21 and should be pushed into the empty conduits 32, which are installed in the concrete, to get connected with the light projectors 31.

Figure 14:
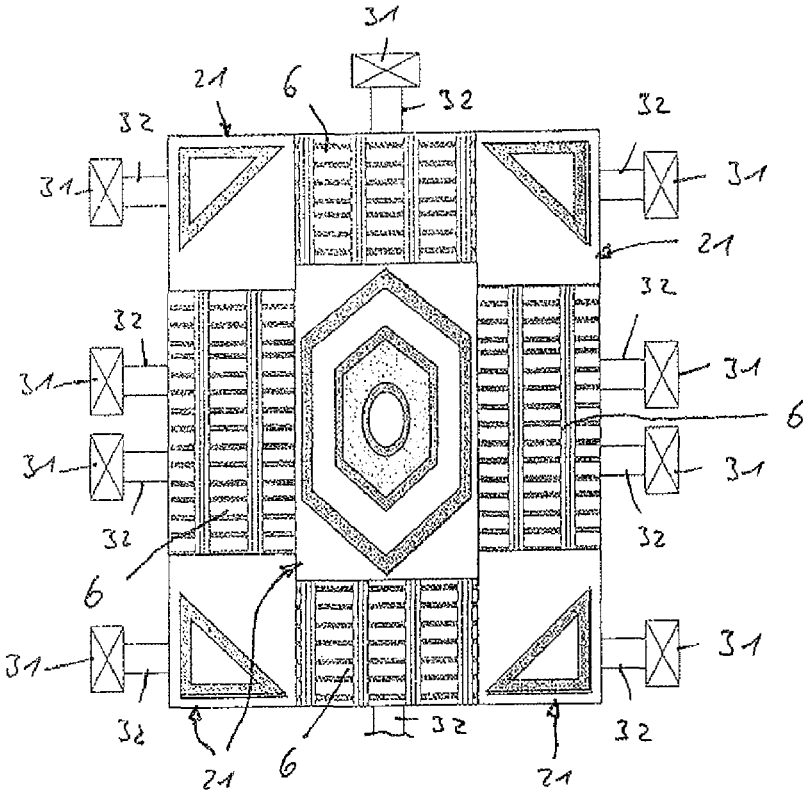

According to FIG. 14, some of the light projectors 31 can be placed on each side of the mosaic panel 21, depending on the circumference of the cable and light variants. The individual and in particular variable light and the appearing colors require a good coordination in each festively illuminated portion of the mosaics. It is necessary to create a laying layout for the desired colors and it is important to label the different cables in this context before they are connected to the light projectors 31. After that, the cable channel system is closed with resistant compressed fiber plate 6 and the same is glued thereto.

Figure 15:
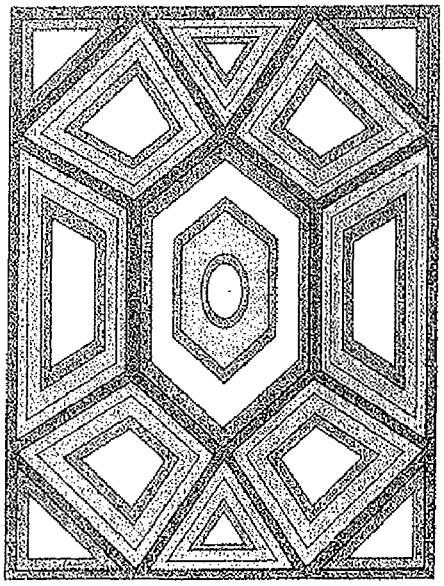

In the stage shown in FIG. 15, the standard mosaic art is installed between the panels 21 of the festively illuminated crystal mosaic and with this, the design is finished. At the end, the floor 20 is grouted. If it is desired to integrate, e.g., water jet cut marble instead of standard mosaic art, the prefabricated crystal mosaic panel needs a different height prior to the installation. Different heights can be implemented in a particularly simple manner by selecting suitable plates 6, 8 with respect to their thickness and/or quantity.

After that, the floor 20 is complete. The mosaic work is now finally completed. With this installation technique it is possible to combine any kind of material with different heights such as glass, metal, marble or wood with one another. Thus, there are no restrictions for modifying portions of the art panel, e.g. with engraving techniques or inlaying techniques, because it is possible to prefabricate these units in a separate factory. This installation system is unique and represents a leading position worldwide in this specific field.

Figure 16:
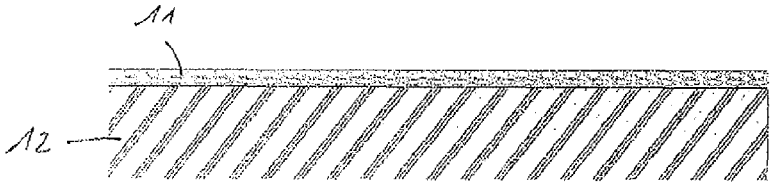

According to FIG. 16, the synthetic resin layer 11 is formed, e.g. by a 2-K epoxy resin (e.g. UZIN PE 460 and UZIN Perlsand) and serves for priming, blocking, solidifying, and sealing of subfloors, and serves as blocking primer for floors with excessive moisture. Consisting of two components, low viscosity, very good penetration capability, rapidly curing, suitable for mineral subfloors such as concrete and cement screed. To be applied two times and after the second time, quartz sand is to be spread over the moist surface so that grip and adhesion for the flowing screed is ensured. Mosaic floors are very sensitive to wetness and moisture because the individual mosaic stones can get detached from the supporting net if the system is not completely watertight.

Figure 17:
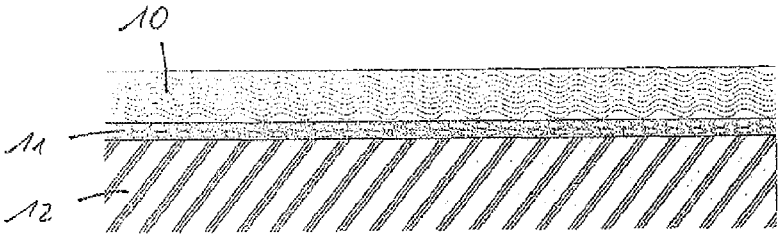

According to FIG. 17, preferably, a self-leveling smoothing cement (e.g. UZIN NC 170 & polymer-modified additive UZIN PE 520) is used as flowing screed layer 10 and serves for smoothening, leveling and building-up, equalizing of floors in any layer thicknesses (preferably in a height of 1-9 mm). This cement compound can basically be applied up to a height of 25 mm. For greater heights, the basis should be filled first with a normal cement screed and only then, the flowing screed is to be applied in the appropriate height. It is mixed with water, very flexible and highly polymer-modified, very good flowability, rapidly curing, ready to walk on after 1-2 hours, ready for laying after 24 hours, low-stress, very high compression and flexural strength, suitable for cement screed and concrete sub-floors, suitable for any kind of load conditions, including industrial and heavy-duty areas. To achieve an even higher flexibility, the flowing screed should additionally be provided with a polymer-modified additive. Said flowing cement compound ensures the necessary filling height and an even and smooth surface for the mosaic installation; because every unevenness of the floor prior to the installation is visible later on the installed mosaic surface.

For filling heights of more than 25 mm, a suitable filling material can be used (e.g. UZIN NC 190 with flexible polymer-modified additive UZIN PE 520).

Figure 18:
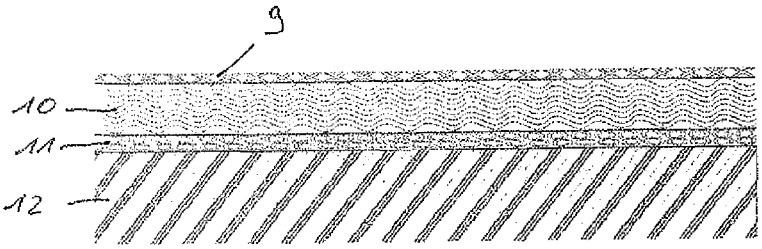

According to FIG. 18, as primer layer 9, a dispersion primer can be used (e.g. UZIN Fliesengrund); the same serves for subfloor preparation of mineral subfloors and for better adhesion of the tile adhesive. Low viscosity, water soluble, dust binding, very good penetration capability, rapidly drying, water- and alkali-resistant, elastic, suitable for concrete and cement screeds.

Figure 19:
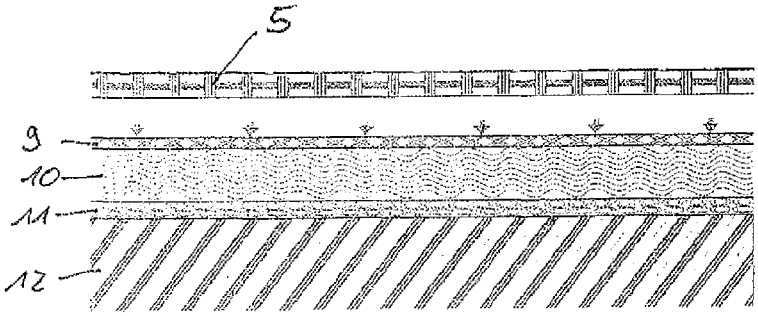

According to FIG. 19, a resin-bonded thick polyester fiber hardboard (e.g. UZIN Multimoll Top 4) can be used as flexible plate 5 as stress-separating underlay for mosaic, tile and natural stone flooring. Easy to cut and to lay, good compression strength, stress-relieving, decoupling, moisture-resistant, heat- and rot-resistant, thickness e.g. 4 mm. The decoupling plate serves as underlayment for the mosaic panel and reduces stress between the surface and the floor-cement system.

Figure 20:
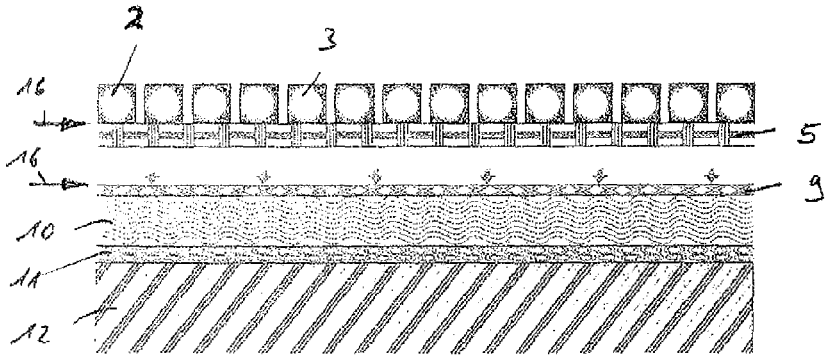

According to FIG. 20, a highly flexible mosaic adhesive for marble/natural stone (e.g. UZIN Stone Plus with polymer-modified additive UZIN Power Mix) is suitable as adhesive 16. This is a white hydraulically rapidly curing, highly polymer-modified thin bed mortar/mosaic adhesive, for marble and natural stone flooring, can be applied up to 10 mm, mixable with water, good stability and wetting ability, high adhesive strength, no marginal discolorations, water-resistant, can be grouted after approximately 24 hours, ready to bear load after 2-3 days, water-resistant, suitable for all types of natural stones which have a tendency to discoloration or deformation, suitable for subfloors such as concrete or cement screeds. Workable for approximately 2.5 hours. Due to its high flexibility, this adhesive is extremely suitable for mosaic panels. This adhesive must be polymer-modified (e.g. with UZIN Power Mix).

Suitable as joint material 1 is, according to FIG. 21, a grout for mosaic floors (e.g. UZIN Brilliant Stone and polymer-modified additive Brilliant Plus). This is a water-resistant, flexible, hydraulically curing grout for widths of 1-6 mm for decorative grouting of wall and floor surfaces. To be mixed with water, polymer-modified, very good to wash, strong flank adhesion, lightfast, color brilliance, finely closed joint surface, open to diffusion, efflorescence-resistant, ready to walk on after 24 hours, ready to bear load after 2 days, suitable for surfaces with absorbent properties as well as for natural stone and marble mosaic. Should additionally be modified with polymer-modified additive (e.g. UZIN Brilliant Plus).

Finally, according to FIG. 22, a neutral-curing silicone joint sealing compound can be provided for closing and filling the connection joints and expansion joints. Ready to use in cartridge, self-adhesive, rapidly curing, highly elastic, disinfectable, no discoloration on natural stones, suitable for connection and expansion joints on natural stones, tiles and metal parts.

The invention claimed is:

1. A mosaic floor including layers, comprising at least one mosaic section comprising illuminating elements that are integrated into the mosaic floor, and a structure that comprises at least the following layers:

a mosaic layer that has a plurality of individual mosaic elements and a plurality of individual illuminating elements, wherein said illuminating elements are connected to electric cables or light conductors that are introduced from below, a channel layer that comprises at least one rigid plate having a channel system that is open to the top or to the bottom, in which the electric cables or the light conductors are laid.

2. The mosaic floor according to claim 1, wherein the layered structure of the mosaic section provided with the illuminating elements further comprises an intermediate layer comprising a flexible plate on top of which the mosaic layer rests.

3. The mosaic floor according to claim 1, wherein the mosaic layer and the channel layer with the electric cables or light conductors laid in the channel system form a prefabricated unit.

4. The mosaic floor according to claim 1, wherein at least one section of the mosaic floor which has no illuminating elements has a layered structure comprising a cover layer comprising at least one of a plurality of individual mosaic elements and/or at least one floor covering element.

5. The mosaic floor according to claim 4, wherein the cover layer has a different thickness than the mosaic layer provided with the illuminating elements, and within the respective section or mosaic section, for achieving an even mosaic floor, at least one of the other layers has an adapted thickness and the layered structure has an adapted number of layers.

6. A method for laying a mosaic floor comprising at least one mosaic section having integrated illuminating elements comprising, prefabricating at least one unit comprising a mosaic layer further comprising mosaic elements and illuminating elements, and a channel layer comprising a rigid plate with an channel system integrated therein, wherein electric cables or light conductors connected to the illuminating elements are laid in said channel system, applying the prefabricated units onto a floor, connecting the electric cables to an electric supply or the light conductors to a light supply of the illuminating elements.

7. The mosaic floor of claim 1, wherein the layered structure of the mosaic section provided with the illuminating elements further comprises an intermediate layer comprising a rigid plate which rests on top of the channel layer and closes the channel system to the top.

8. The mosaic floor of claim 1, wherein the layered structure of the mosaic section provided with the illuminating elements further comprises an intermediate layer comprising a rigid plate on top of which the channel layer rests and closes the channel system to the bottom.

9. The mosaic floor of claim 1, wherein the layered structure of the mosaic section provided with the illuminating elements further comprises a floor layer comprising a flowing screed layer.

10. The mosaic floor of claim 9, wherein said floor layer comprises a synthetic resin between the flowing screed layer and a floor.

11. The mosaic floor of claim 10, wherein the floor is made from concrete.

12. The mosaic floor of claim 9, wherein said floor layer comprises a primer layer on top of the flowing screed layer.

13. The mosaic floor of claim 4, wherein said floor covering element is one of: a marble plate, a metal plate and a ceramic plate.

14. The mosaic floor of claim 1, wherein at least one section of the mosaic floor which has no illuminating elements comprises a layered structure comprising a channel layer comprising a rigid plate having a channel system that is open to the top or to the bottom, and wherein the electrical cables or light conductors of adjacent mosaic sections with integrated illuminating elements are laid.

15. The mosaic floor of claim 1, wherein at least one section of the mosaic floor which has no illuminating elements has a layered structure comprising an intermediate layer comprising a flexible plate on top of which the mosaic layer rests.

16. The mosaic floor of claim 2, wherein at least one section of the mosaic floor which has no illuminating elements has a layered structure comprising a second intermediate layer comprising a rigid plate which rests on top of the channel layer, on top of which the first intermediate layer rests and which closes the channel system to the top.

17. The mosaic floor of claim 1, wherein at least one section of the mosaic floor which has no illuminating elements has a layered structure comprising a floor layer comprising a flowing screed layer.

18. The mosaic floor of claim 17, wherein said floor layer comprises a synthetic resin layer between the flowing screed layer and a floor.

19. The mosaic floor of claim 18, wherein said floor is made from concrete.

20. The mosaic floor of claim 17, wherein said floor layer comprises a primer layer on top of the flowing screed layer.

* * * * *